US007523631B2

(12) United States Patent
Fujibayashi et al.

(10) Patent No.: US 7,523,631 B2
(45) Date of Patent: Apr. 28, 2009

(54) COOLING DEVICE, MANUFACTURING METHOD, AND MANUFACTURING LINE FOR HOT ROLLED STEEL BAND

(75) Inventors: Akio Fujibayashi, Tokyo (JP); Masato Sasaki, Tokyo (JP); Yoshimichi Hino, Tokyo (JP); Atsushi Watanabe, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 476 days.

(21) Appl. No.: 10/508,029

(22) PCT Filed: Aug. 8, 2002

(86) PCT No.: PCT/JP02/08113

§ 371 (c)(1),
(2), (4) Date: Apr. 6, 2005

(87) PCT Pub. No.: WO2004/014577

PCT Pub. Date: Feb. 19, 2004

(65) Prior Publication Data

US 2006/0060271 A1 Mar. 23, 2006

(51) Int. Cl.
*B21B 27/06* (2006.01)

(52) U.S. Cl. ..... 72/201

(58) Field of Classification Search ..... 72/236, 72/201, 202, 342.2, 128, 342.5; 266/46, 266/113; 148/660, 661
See application file for complete search history.

(56) References Cited

U.S. PATENT DOCUMENTS 3,479,853 A * 11/1969 Berry ..... 72/128
3,856,281 A * 12/1974 Bertolotti et al. ..... 134/64 R
4,047,985 A * 9/1977 Greenberger ..... 134/15

(Continued)

FOREIGN PATENT DOCUMENTS

EP 0 464 890 A1 1/1992

(Continued)

OTHER PUBLICATIONS

Microfilm of the specification and drawings annexed to the request of Japanese Utility Model Application No. 140156/1983 (Laid-open No. 52009/1985) (Nippon Steel Corp.), Apr. 12, 1985, claims; p. 5, line 11 to p. 9, line 13; Figs. 2 to 7.

(Continued)

*Primary Examiner*—Dana Ross
*Assistant Examiner*—Teresa Bonk
(74) *Attorney, Agent, or Firm*—Frishauf, Holtz, Goodman & Chick, P.C.

(57) ABSTRACT

A cooling apparatus for a hot rolled steel strip comprising: top surface cooling means provided above a hot rolled steel strip which is transferred with transfer rollers; and a bottom surface cooling means provided below the hot rolled steel strip, each of the top surface cooling means and the bottom surface cooling means comprising: a protective member having at least one cooling water passage hole; at least one cooling water header opposing the hot rolled steel strip separated by the protective member; and cooling water jetting nozzles protruding from the cooling water header, wherein the tips of the cooling water jetting nozzles are disposed farther from the hot rolled steel strip than the surface, opposing the hot rolled steel strip, of the protective member.

15 Claims, 13 Drawing Sheets

U.S. PATENT DOCUMENTS

| | | | | |
|---|---|---|---|---|
| 4,423,856 | A * | 1/1984 | Takahashi et al. | 266/106 |
| 4,497,180 | A * | 2/1985 | Graham | 62/63 |
| 4,570,453 | A * | 2/1986 | Kamio et al. | 62/375 |
| 5,186,018 | A * | 2/1993 | van Ditzhuijzen et al. | 62/374 |

FOREIGN PATENT DOCUMENTS

| | | | |
|---|---|---|---|
| EP | 1 210 993 | A1 | 6/2002 |
| JP | 57156830 | A * | 9/1982 |
| JP | 60-52009 | | 4/1985 |
| JP | 62-259610 | A | 11/1987 |
| JP | 04238618 | A * | 8/1992 |
| JP | 6-31634 | A | 2/1994 |
| JP | 8-281556 | A | 10/1996 |
| JP | 8-309662 | A | 11/1996 |
| JP | 9-1460 | A | 1/1997 |
| JP | 9-155743 | A | 6/1997 |
| JP | 2001-246410 | A | 9/2001 |
| JP | 2001-246411 | A | 9/2001 |
| JP | 2001-246413 | A | 9/2001 |
| JP | 2002-239623 | A | 8/2002 |

OTHER PUBLICATIONS

Communication dated Jan. 18, 2008, including a Supplementary European Search Report for EP application 07118787.6-2302.

* cited by examiner

COOLING DEVICE, MANUFACTURING METHOD, AND MANUFACTURING LINE FOR HOT ROLLED STEEL BAND

This application is the United States national phase application of International Application PCT/JP02/08113 filed Aug. 8, 2002.

TECHNICAL FIELD

The present invention relates to a cooling apparatus for hot rolled steel strip, a manufacturing method for hot rolled steel strip and a production line for hot rolled steel strip using the cooling apparatus.

BACKGROUND ART

In general, a hot rolled steel strip is manufactured by heating a slab to a predetermined temperature in a reheating furnace, hot rolling the heated slab into a sheet bar having a predetermined thickness using a roughing mill, hot rolling the sheet bar into a steel strip having a predetermined thickness using a finishing mill having a plurality of rolling stands, transferring and cooling the hot rolled steel strip on a run-out table using a cooling apparatus, and then coiling the steel strip on a coiler. The run-out table is a transfer apparatus provided downstream of the finishing mill to transfer the hot rolled steel strip on a plurality of transfer rollers disposed at a suitable pitch.

A conventional cooling apparatus provided on the run-out table is so contrived as to mainly aim stable transfer of steel strip, as typically shown in FIGS. 1A and 1B. FIG. 1A is a schematic view of such a cooling apparatus and FIG. 1B is a lateral view of the apparatus shown in FIG. 1A. As shown in FIG. 1A, the top surface cooling of a steel strip 9 is carried out by sprinkling laminar flow cooling water 32 from laminar flow cooling nozzles 31 in cylindrical pipes which are linearly provided directly above transfer rollers 7 in the width direction of the steel strip 9 in such a way that the steel strip 9 does not undulate on the transfer line due to water pressure. On the other hand, as shown in FIG. 1B, the bottom surface cooling of the steel strip 9 is carried out by intermittently jetting cooling water 34 from spray nozzles 33 provided between the transfer rollers 7 to the steel strip 9.

Recently, excellent workability, high strength with low carbon equivalent and the like have been required for a hot rolled steel strip. For these requirements, grain refining of steel strip is effective, and thus the steel strip need to be more rapidly cooled after hot rolling. In particular, the steel strip having low carbon equivalent such as an ultra low carbon steel strip should be cooled at a cooling rate exceeding 200° C./s because austenitic grains after hot rolling tend to become coarse due to recrystallization.

To conduct such rapid cooling, Japanese Unexamined Patent Application Publication No. 62-259610 discloses a method for increasing cooling capability for bottom surface of steel strip using a bottom surface cooling apparatus where cooling water jetting plates having a plurality of holes are disposed between transfer rollers and also function as a guide, and jetting cooling water toward the steel strip through the holes at different angles.

However, the method described in Japanese Unexamined Patent Application Publication No. 62-259610 causes various problems as follows.

(1) A hot rolled steel strip undulates vertically while being transferred on a run-out table when the leading end of the hot rolled steel strip lies between a finishing mill and a coiler, because the hot rolled steel strip is not under any tension. Cooling of such a tension free steel strip in this method causes further vertical waves. As a result, a sufficient volume of cooling water is not applied and it is impossible to cool, for example, a steel strip of 3 mm in thickness at a cooling rate exceeding 200° C./s.

(2) This method does not enable the top and bottom surfaces of the steel strip to be cooled at the same cooling rate.

(3) This method presupposes cooling at a water flow rate of about 1,000 L/min·m$^2$, but a higher water flow rate is required to cool a steel strip of, for example, about 3 mm in thickness at a cooling rate exceeding 200° C./s. In the cooling apparatus used in this method, as shown schematically in FIG. 2A, a higher water flow rate causes jetted cooling water to remain in a narrow space between the cooling water jetting plate and the steel strip around the center in the width direction of the steel strip. Therefore, desired cooling is not performed because of a decrease in the flow velocity of the jetted cooling water. On the contrary, around the edge in the width direction of the steel strip, the cooling water flows down from the edge without remaining and therefore allows desired cooling. As a result, as shown in FIG. 2B, the temperature profile in the width direction of the steel strip shows an inverted-V shape, in which both edges are cooled to target temperature but the center is cooled to temperature higher than the target temperature. Thus, uniform cooling in the width direction is not performed.

Widening the space between the cooling water jetting plate and the steel strip, as shown in FIG. 3A, prevents cooling water from remaining at the center in the width direction of the steel strip, performing desired cooling. However, a large amount of cooling water is drained from the center toward the edges in the width direction of the steel strip after cooling, disrupting the cooling water flow at the edge in the width direction to lower cooling capability. As a result, as shown in FIG. 3B, the temperature profile in the width direction of the steel strip shows a V shape, in which both edges are cooled to temperature higher than target temperature and the center is cooled to the target temperature. Thus, uniform cooling in the width direction is not performed.

When the space between the cooling water jetting plate functioning also as a guide and the steel strip is arranged properly, the temperature profile in the width direction of the steel strip after cooling shows an M shape which is the sum of the inverted-V shape in FIG. 2B and the V shape in FIG. 3B. Thus, uniform cooling in the width direction is not performed, either.

(4) According to this method, when the cooling water is jetted toward the steel strip at different angles from a plurality of holes in the cooling water jetting plate functioning as nozzles, the distance that the cooling water travels varies depending on the nozzles. The cooling water jetted aslant to the steel strip travels a longer distance, thus greatly reducing the flow velocity to fail to efficiently cool the steel strip. As described in (3), cooling capability is greatly affected by the jetted cooling water, so it is more difficult to uniformly cool the steel strip in the width direction.

DISCLOSURE OF THE INVENTION

An object of the present invention is to provide a cooling apparatus for hot rolled steel strip which stably transfers a hot rolled steel strip and cools it rapidly and uniformly after hot rolling, a manufacturing method and a production line for hot rolled steel strip using such a cooling apparatus.

The above-mentioned object is accomplished by a cooling apparatus for hot rolled steel strip comprising: top surface cooling means provided above a hot rolled steel strip transferred with transfer rollers after hot rolling to cool the top surface of the hot rolled steel strip; and bottom surface cooling means provided below the hot rolled steel strip to cool the bottom surface of the hot rolled steel strip, wherein each of the top surface cooling means and the bottom surface cooling means comprises: a protective member disposed close to the surface of the hot rolled steel strip and having at least one cooling water passage hole; at least one cooling water header opposing the hot rolled steel strip separated by the protective member; and cooling water jetting nozzles protruding from the cooling water header and jetting cooling water approximately vertically toward the surface of the hot rolled steel strip through the cooling water passage hole, the tips of the cooling water jetting nozzles being disposed farther from the hot rolled steel strip than the surface, opposing the hot rolled steel strip, of the protective member.

When such a cooling apparatus for hot rolled steel strip is provided on a run-out table in a production line for hot rolled steel strip, hot rolled steel strip can be transferred stably, and cooled rapidly and uniformly.

EMBODIMENTS OF THE INVENTION

Figure 4:
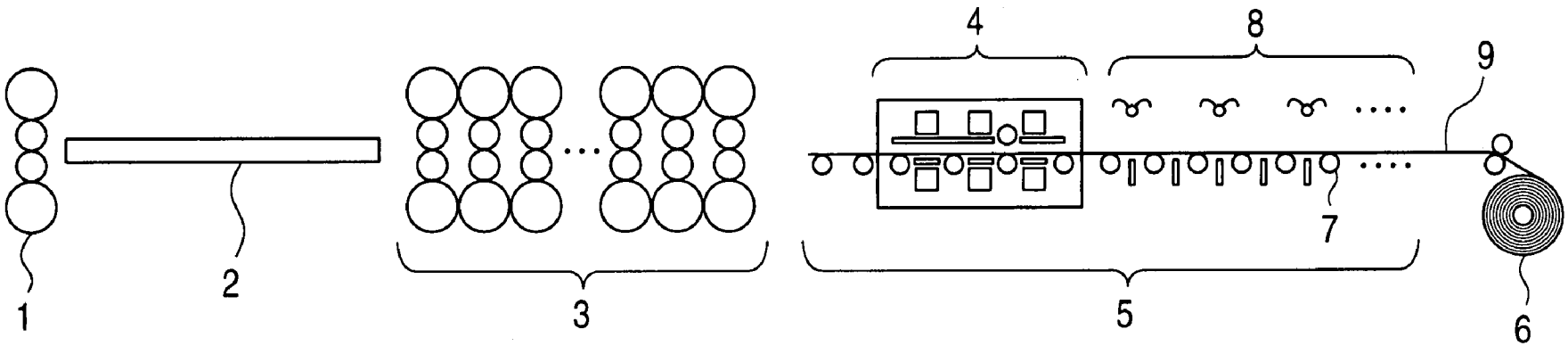
FIG. 4 shows an example of a production line for hot rolled steel strip provided with a cooling apparatus for hot rolled steel strip according to the present invention.

FIG. 4 shows an example of a production line for hot rolled steel strip provided with a cooling apparatus for hot rolled steel strip according to the present invention.

Figure 1A:
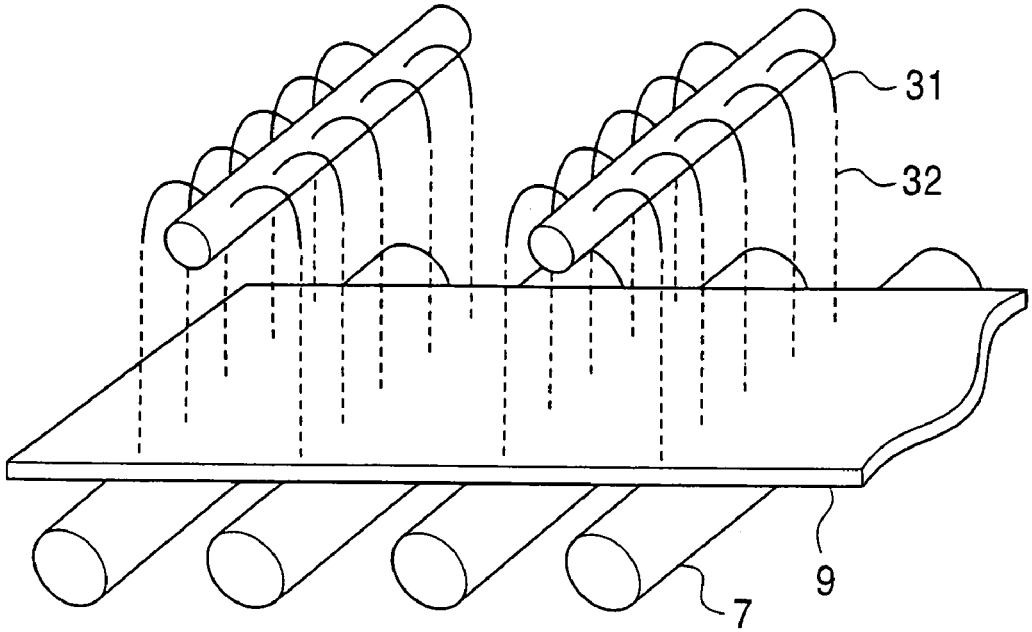
FIG. 1A PRIOR ART
FIGS. 1A and 1B show an example of a conventional cooling apparatus for hot rolled steel strip installed on a run-out table.
Figure 1B:
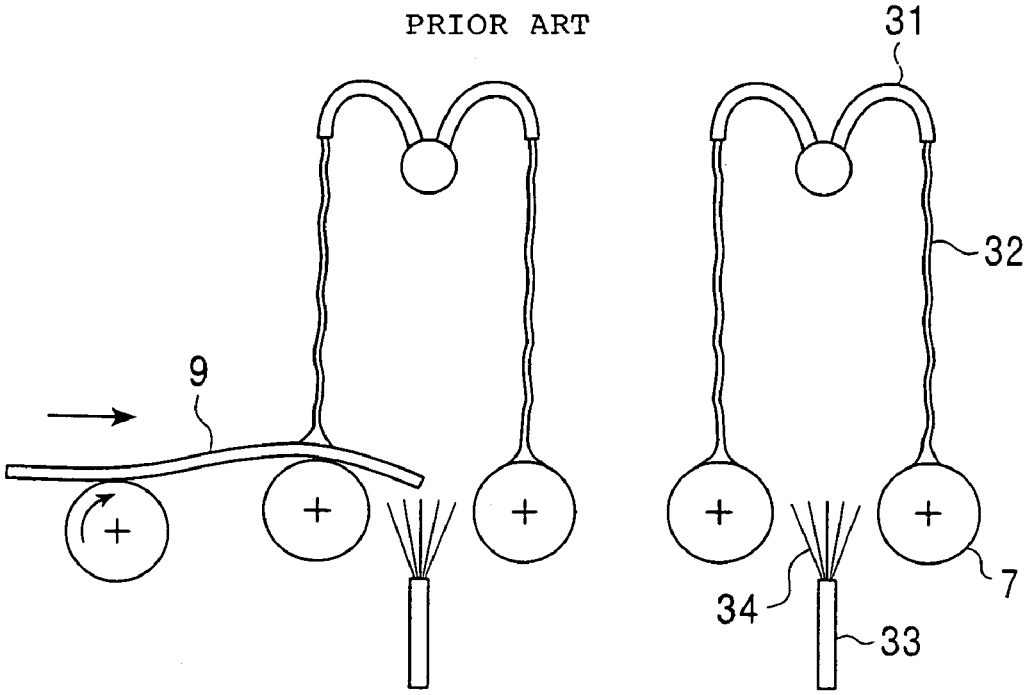
FIG. 1B PRIOR ART
Figure 2A:
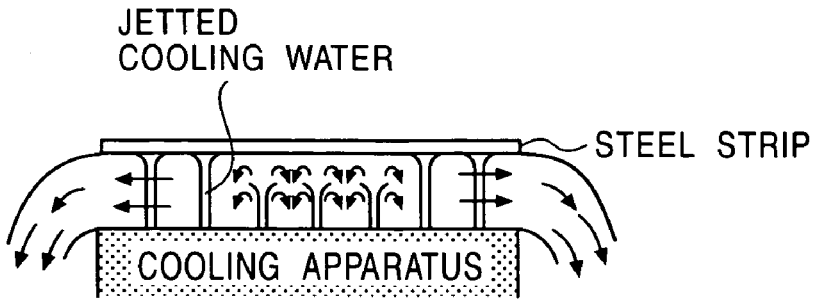
FIGS. 2A and 2B schematically show, respectively, behavior of cooling water and temperature profile in the width direction of steel strip when the cooling apparatus disclosed in Japanese Unexamined Patent Application Publication No. 62-259610 is applied.
Figure 2B:
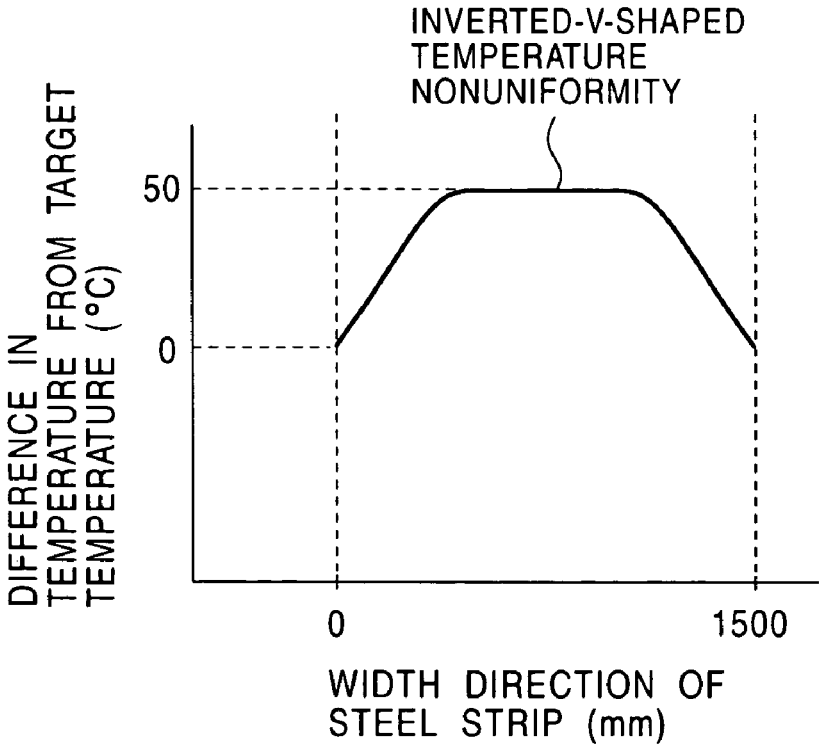

The production line includes a roughing mill 1 to roll a slab into a sheet bar 2, a finishing mill 3 including a plurality of rolling stands to roll the sheet bar 2 into a hot rolled steel strip 9 having a predetermined thickness, a run-out table 5 to transfer the hot rolled steel strip 9 after hot rolling on transfer rollers 7, and a coiler 6 to coil the hot rolled steel strip 9. The run-out table 5 is provided, just downstream of the finishing mill 3, with a cooling apparatus 4 according to the present invention to rapidly cool the hot rolled steel strip 9. In addition, the conventional cooling apparatus 8 shown in FIG. 1A may also be provided downstream of the cooling apparatus 4.

Figure 5A:
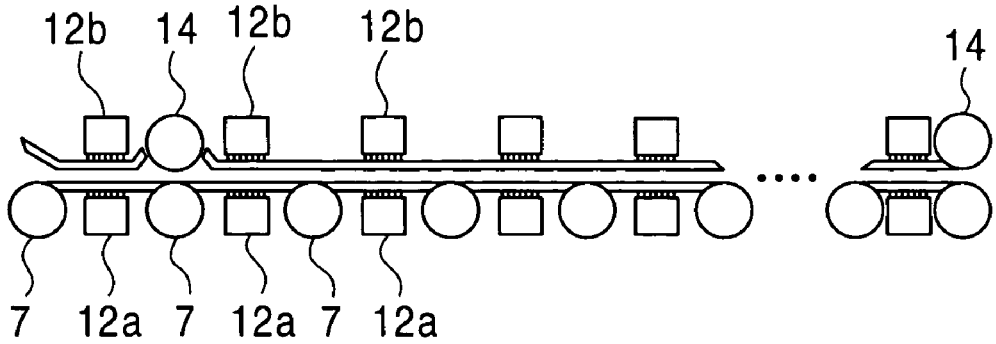
FIGS. 5A and 5B show an example of a cooling apparatus for hot rolled steel strip according to the present invention.
Figure 5B:
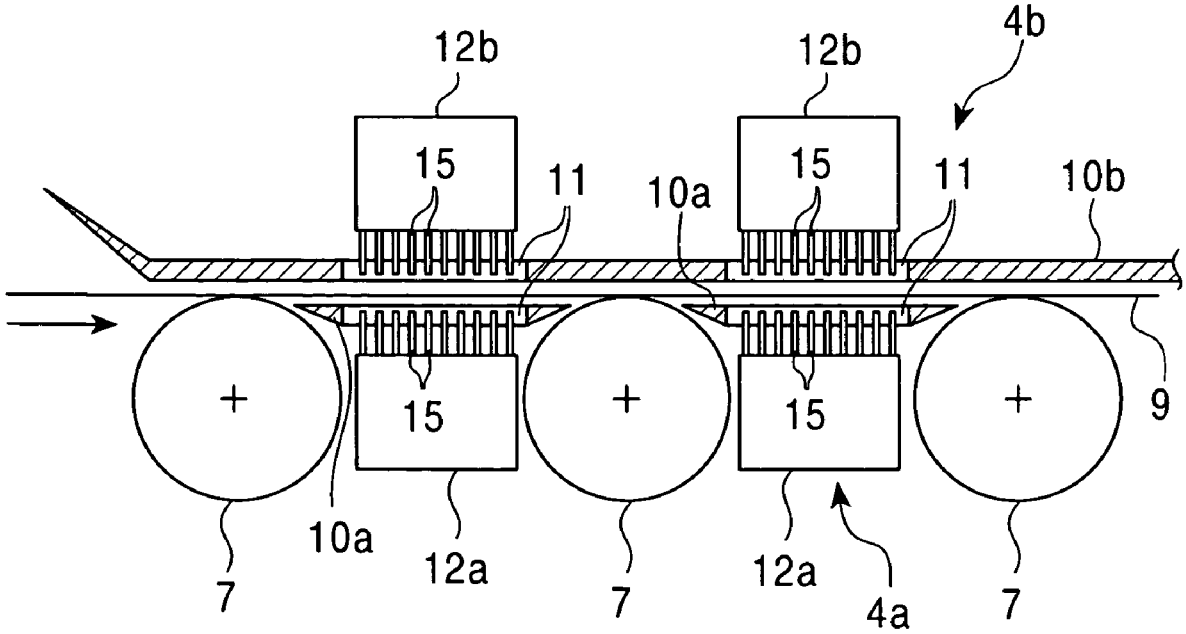

FIG. 5A shows an example of a cooling apparatus for hot rolled steel strip according to the present invention. FIG. 5B is a partially magnified drawing of the cooling apparatus shown in FIG. 5A.

The cooling apparatus for hot rolled steel strip according to the present invention includes bottom surface cooling means 4*a* provided below a hot rolled steel strip 9 to cool the bottom surface of the hot rolled steel strip 9 and top surface cooling means 4*b* provided above the hot rolled steel strip 9 to cool the top surface of the hot rolled steel strip 9.

Each of the cooling means 4*a* and 4*b* is provided with protective member plates 10, consisting of bottom protective members 10*a* and top protective members 10*b*, disposed close and approximately parallel to the surface of the hot rolled steel strip 9, and cooling water headers 12, consisting of bottom surface cooling water headers 12*a* and top surface cooling water headers 12*b*, disposed to oppose the hot rolled steel strip 9 separated by the protective members 10*a* or 10*b*. Each of the cooling water headers 12*a* or 12*b* is provided with protruding cooling water jetting nozzles 15 at a suitable pitch in the width and longitudinal directions of a run-out table. The tips of the cooling water jetting nozzles 15 are disposed farther from the hot rolled steel strip 9 than the surfaces, opposing the hot rolled steel strip 9, of the protective members 10. Furthermore, each of the protective members 10 has a plurality of cooling water passage holes 11 to pass cooling water. Through the cooling water passage holes 11, each of the cooling water jetting nozzles 15 jets cooling water approximately vertically toward the surface of steel strip.

Two guide rollers 14 are provided above the hot rolled steel strip 9 approximately opposing the transfer rollers 7 provided under the hot rolled steel strip 9. The guide rollers 14 allow to transfer the hot rolled steel strip 9 more stably. Preferably, the guide rollers 14 are provided at at least one position above the hot rolled steel strip 9 approximately opposing the transfer rollers 7. The guide rollers 14 may be provided at all the positions approximately opposing the transfer rollers 7.

The top surface protective members 10*b* of the top surface cooling means 4*b* are disposed close to the surface of steel strip at positions other than where the guide rollers 14 are provided.

On the other hand, the bottom surface protective members 10*a* of the bottom surface cooling means 4*a* are disposed between the transfer rollers 7 provided in the longitudinal direction of the run-out table at a suitable pitch. Therefore, the cooling water jetting nozzles 15 of the bottom surface cooling water headers 12*a* are disposed between the transfer rollers 7. In FIG. 5A, the bottom surface cooling water headers 12*a* are provided between the transfer rollers 7, but the bottom surface cooling water headers 12*a* may be provided in such a way that they cover more than one of the transfer rollers 7 by passing below the conveying rollers 7. At least one bottom surface cooling water header 12*a* is provided between two adjacent transfer rollers 7, and preferably, a plurality of bottom surface cooling water headers 12*a* is separately provided in the longitudinal direction and/or the width direction of the run-out table. The cooling water headers 12 separately provided can minutely control the cooling of the hot rolled steel strip 9. When the cooling water headers 12 are separately provided in the longitudinal direction, for example, the cooling starting temperature of the steel strip 9 can be kept constant by minutely changing the cooling starting position of the cooling water headers 12 in response to the cooling starting point of the steel strip depending on the transfer speed of the steel strip. When the cooling water headers 12 are separately provided in the width direction, effective cooling is possible by selecting the cooling water headers 12 in response to various widths of the steel strips.

With regard to the top surface cooling water headers 12*b*, the same effect is achieved. Preferably, the top surface cooling water headers 12*b* are arranged to oppose the bottom surface cooling water headers 12*a* separated by the hot rolled steel strip 9. This provides the following advantages: The top and bottom cooling can be easily balanced; the positions of the headers to start cooling the top and bottom surfaces can be easily adjusted; the hot rolled steel strip 9 can be stably transferred due to the water pressure from the upside and downside.

Preferably, each of the cooling water jetting nozzles 15 of the top surface cooling means 4*b* protruding from each of the top cooling water headers 12 is arranged to approximately oppose each of the cooling water jetting nozzles 15 of the bottom surface cooling means 4*a* protruding from each of the bottom cooling water headers 12 separated by the hot rolled steel strip 9. This is effective to bring the cooling of the top and bottom surfaces and the water pressure thereof into balance.

As described above, each of the cooling water jetting nozzles 15 protrudes from each of the cooling water headers 12 and is disposed so as to jet cooling water approximately vertical to the surface of the steel strip. In other words, when nozzle installation surfaces of the cooling water headers 12 are parallel to the steel strip as shown in FIG. 5B, the cooling water jetting nozzles 15 vertically protrude from the cooling water headers 12. In this arrangement, cooling water being jetted from the nozzles is less affected by the jetted cooling water, as in the cooling apparatus disclosed in Japanese Unexamined Patent Application Publication No. 62-259610. Furthermore, the flow velocity of the cooling water, which is jetted from the nozzles and collides with the steel strip, is almost equal in all nozzles so as to conduct uniform cooling.

Laminar nozzles are generally used as the cooling water jetting nozzles 15. Since the cooling water jetting outlets of laminar nozzles are cylindrical, jetted water flow collides with the steel strip 9 as laminar flow without divergence. Here, the cylindrical laminar flow is primarily laminar flow but it may contain some turbulent flow.

Figure 6A:
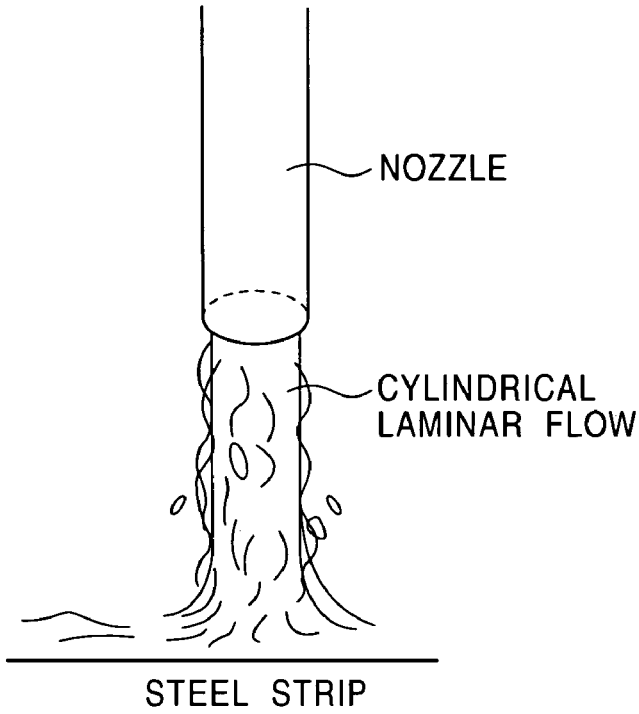
FIGS. 6A and 6B schematically show cylindrical laminar flow and non-laminar flow, respectively.
Figure 6B:
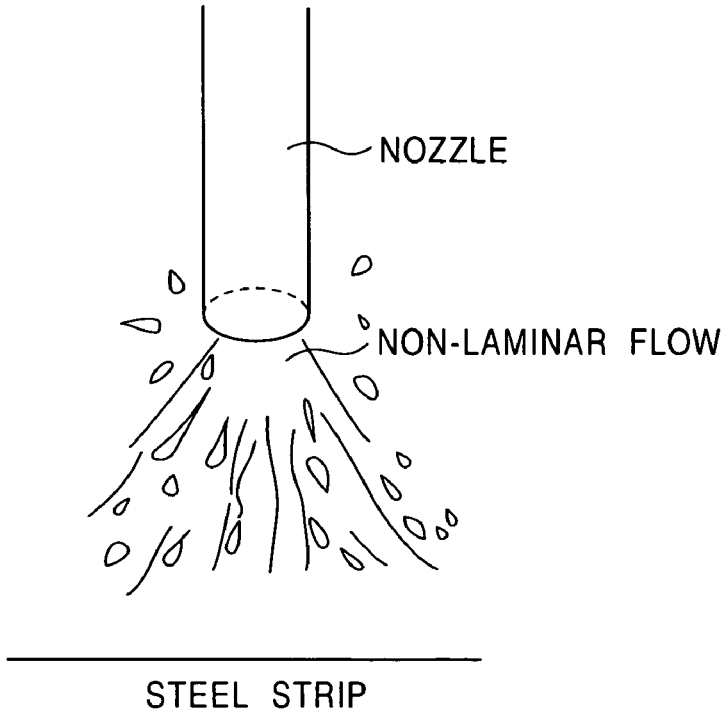

FIGS. 6A and 6B, respectively, schematically show the cylindrical laminar flow and the non-laminar flow.

In the cylindrical laminar flow, the water flow reaches the steel strip without divergence to give good cooling efficiency, resulting in rapid cooling at a rate exceeding 200° C./s. On the other hand, in the non-laminar flow, since the flow velocity of the cooling water jetted from nozzles is reduced by cooling water remaining between the steel strip and the nozzles, even if the nozzles are disposed close to the steel strip, the cooling efficiency is low.

The conventional cooling apparatus uses laminar flow cooling nozzles for cooling the top surface of steel strip. However, since the main cooling is carried out by film boiling in which cooling water is poured over the entire steel strip to cover its surface with cooling water, the cooling rate is 100° C./s at highest. On the other hand, the cooling apparatus according to the present invention uses laminar nozzles as cooling water jetting nozzles as the conventional cooling apparatus, but the cooling apparatus according to the present invention can jet a large amount of cooling water at a water flow rate exceeding about 2,500 L/min·m$^2$. As a result, the cooling water covers the entire steel strip and also the cooling water jetted from the nozzles is directly applied to the steel strip, making it possible to cool the steel strip of about 3 mm in thickness at a cooling rate exceeding 200° C./s. The cooling rate depends on the thickness of steel strip and increases as the thickness becomes thinner. When a cooling condition such as the water flow rate is constant, the product of the strip thickness and the cooling rate is almost constant. Accordingly, even when the strip is thick, the desired cooling rate can be achieved, for example, by increasing the water flow rate.

The diameter of the cooling water jetting nozzles of the present invention is preferably 1 to 10 mm. When the diameter is smaller than 1 mm, it is difficult to generate the cylindrical laminar flow. Since the cooling using the cooling apparatus according to the present invention needs collision pressure, the flow velocity at nozzle outlets is constant and the amount of water increases with increasing diameter of jetting outlets. However, since cooling capability is saturated at a certain amount of water, the jetting outlet diameter should be 10 mm or less from an economic standpoint.

The above-mentioned protective members disposed between cooling water headers and steel strip play two roles of stably transferring the steel strip and protecting the cooling water headers and the cooling water jetting nozzles from collision with the steel strip. The cooling water passage holes in the protective members function not only as jetting holes of cooling water and but as drain holes of jetted cooling water.

Figure 7A:
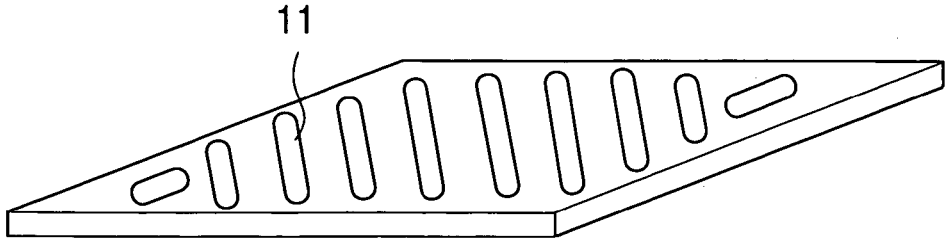
FIGS. 7A, 7B, 7C and 7D show various protective members.
Figure 7B:
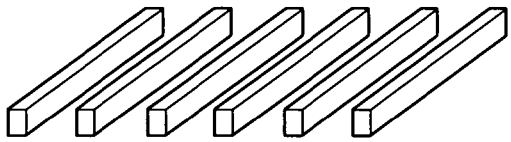
Figure 7C:
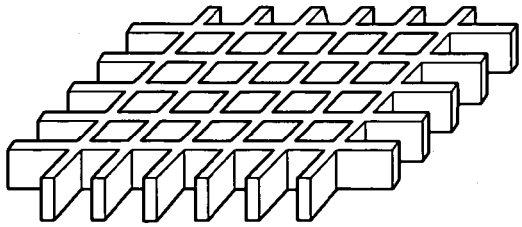
Figure 7D:
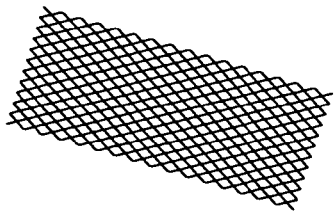

Each of the protective members provided with cooling water passage holes may be, for example, a flat plate having slits shown in FIG. 7A, a group of bars disposed in parallel shown in FIG. 7B, a grid shown in FIG. 7C, or an expanded metal shown in FIG. 7D. Since the protective members shown in FIGS. 7B, 7C, and 7D make contact with the steel strip in a small area, the contact surface pressure increases. This readily causes seizing to the steel strip or indentation flaws on the steel strip. Thereby, flat plates, which have a minimum number of cooling water passage holes to pass the cooling water, provided with slits such as shown in FIG. 7A are preferable. Such protective members prevent flaws from generating on the steel strip.

When flat plates shown FIG. 7A are used as protective members, the plate thickness is preferably 5 mm or more in view of strength, rigidity, or the like of the steel strip. When the plate thickness is less than 5 mm, the plates may become damaged or deformed by collision with the transferred steel strip.

Figure 8A:
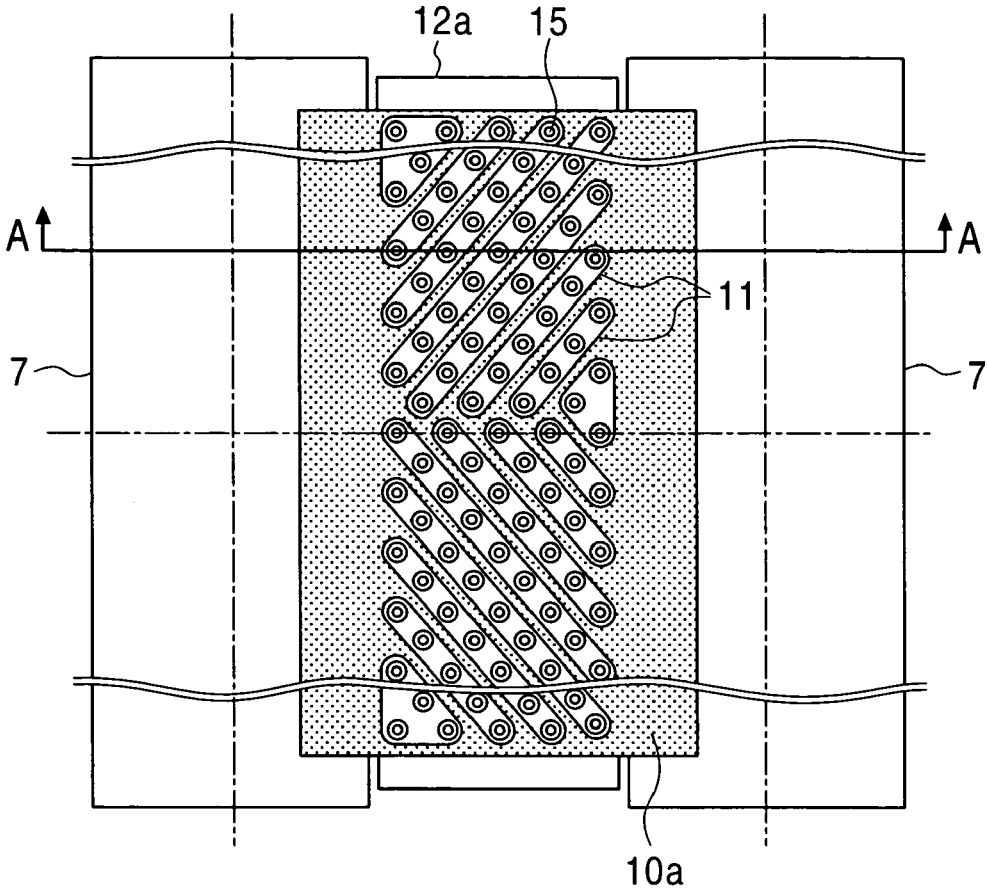
FIGS. 8A and 8B show an example of cooling means provided with the protective member plate having cooling water passage slits shown in FIG. 7A.
Figure 8B:
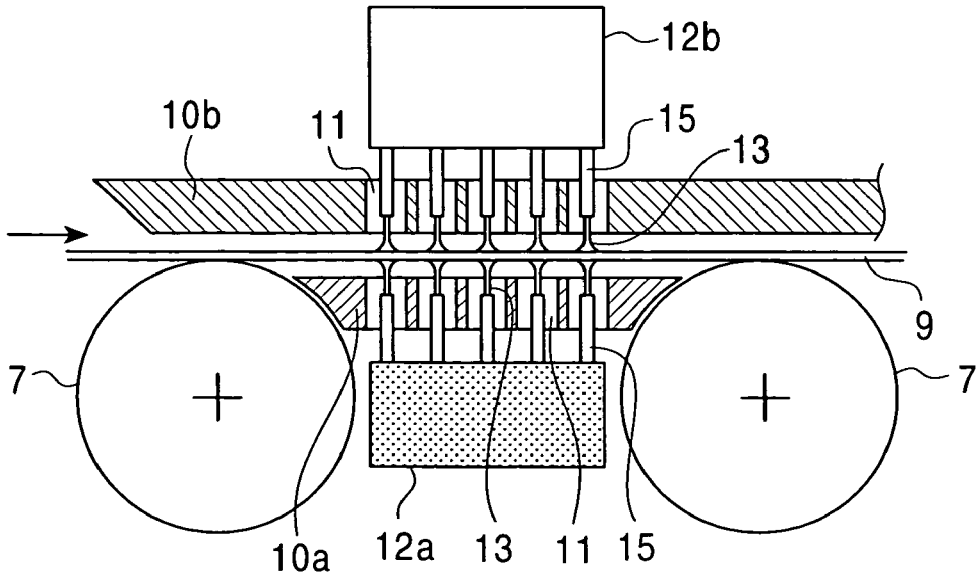

FIGS. 8A and 8B show an example of cooling means which is provided with protective members having cooling water passage holes in a slit shape shown in FIG. 7A. FIG. 8A is a plan view of bottom surface cooling means. FIG. 8B is a cross sectional view taken along line A-A in FIG. 8A. FIG. 8B also shows top surface cooling means.

Each of the slit shaped cooling water passage holes 11 of the protective members 10 is provided with a plurality of cooling water jetting nozzles 15 to jet cooling water as the laminar flow 13. The orifices of the slit shaped cooling water passage holes 11 are preferably as large as possible to drain jetted cooling water, but larger orifices cause collision of the leading end of the steel strip 9 with the slit edge resulting in seizing and damage. Accordingly, the size of an orifice of the slit shaped cooling water passage holes 11 is preferably large enough to hold about two to ten cooling water jetting nozzles 15 in a line, as shown in FIG. 8A. Each of the slit shaped cooling water passage holes 11 may be provided with a plurality of nozzles being linearly disposed in a plurality of lines.

As shown in FIG. 8A, it is not necessary for all the cooling water passage holes 11 to be slit shaped, although the majority of the cooling water passage holes 11 should be slit shaped. If some of the cooling water passage holes 11 are not slit shaped, this does not disturb the passage of the cooling water. In particular, at the center and both edges in the width direction of steel strip, it is difficult to form slit shaped cooling water passage holes 11 due to restriction of the arrangement.

Preferably, the longitudinal direction of the slit shaped cooling water passage holes 11 inclines in the horizontal plane with respect to the transferring direction of the steel strip 9 in order to allow easy drainage to the outside of the cooling apparatus. When the longitudinal direction of the slit shaped cooling water passage holes 11 is perpendicular to the transferring direction of the steel strip 9, it may disturb the flow of the drainage or may cause collision of the leading end of the steel strip 9 with the slit shaped holes giving damage to the steel strip 9 and the cooling water passage holes 11. When the longitudinal direction of the slit shaped cooling water passage holes 11 is parallel to the transferring direction of the steel strip 9, the flow of the drainage is not smooth. As shown in FIG. 8A, the slit shaped cooling water passage holes 11 are disposed so as to be almost axisymmetric to the central line of the run-out table and the longitudinal direction of the cooling water passage holes 11 inclines in the horizontal plane to diverge toward the transferring direction of the steel strip 9. This is more preferable for the smooth flaw of the drainage to the outside of the cooling apparatus.

Figure 9:
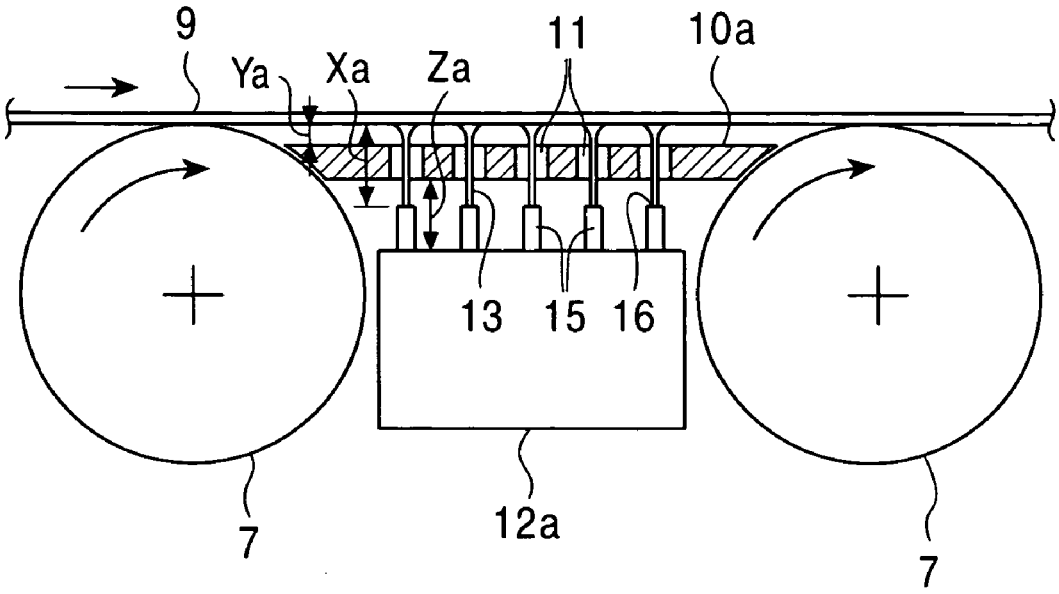
FIG. 9 shows an example of positional relationship between protective member, cooling water header and cooling water jetting nozzles in bottom surface cooling means.

FIG. 9 shows an example of positional relationship between protective member, cooling water header and cooling water jetting nozzles in bottom surface cooling means.

In this example, the thickness of the protective members 10*a* is small, and tips 16 of the cooling water jetting nozzles 15 are disposed below the bottom surface of the protective members 10*a* .

Figure 10:
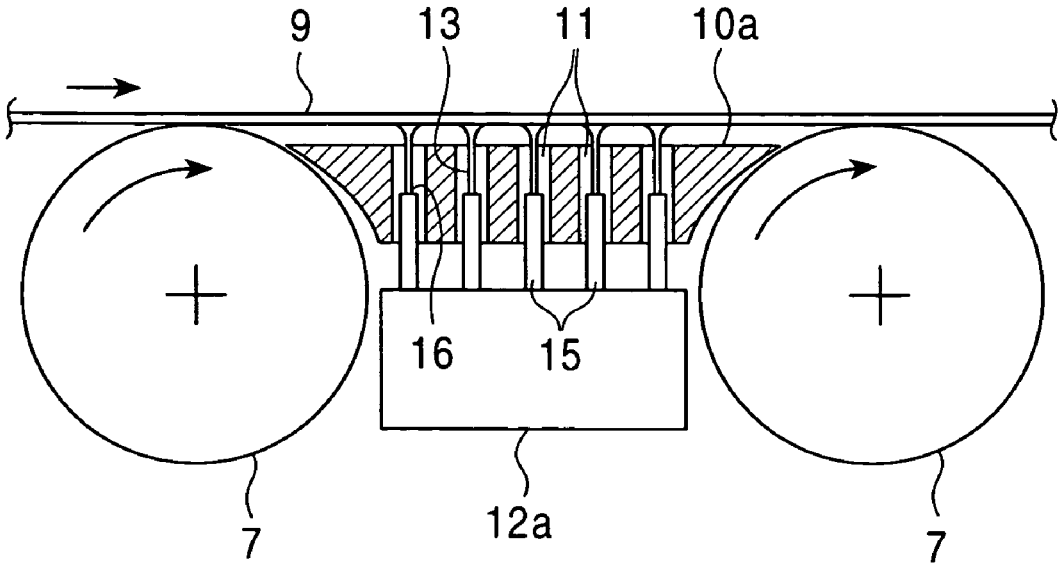
FIG. 10 shows another example of positional relationship between protective member, cooling water header and cooling water jetting nozzles in bottom surface cooling means.

FIG. 10 shows another example of positional relationship between protective member, cooling water header and cooling water jetting nozzles in bottom surface cooling means.

In this example, the thickness of the protective members 10*a* is large, and tips 16 of the cooling water jetting nozzles 15 are disposed inside the cooling water passage holes 11 of the protective members 10*a* .

In the bottom surface cooling means shown in FIG. 9, the distance Xa from the tips 16 of the cooling water jetting nozzles to the surface of the steel strip 9, the distance Ya from the top surface of the protective members 10*a* to the surface of the steel strip, and the distance Za from the bottom surface of the protective members 10*a* to the cooling water headers 12*a* are determined as follows:

First, the impinging velocity of the laminar flow 13 of cooling water to the steel strip and the pitch between the cooling water jetting nozzles 15 are determined so as to achieve a desired cooling rate.

Then, the distance Xa from the tips 16 of the cooling water jetting nozzles to the surface of the steel strip is determined to secure the impinging velocity in view of the diameter of the cooling water jetting nozzles 15. It is preferable that the distance Xa from the tips 16 of the cooling water jetting nozzles to the surface of the steel strip be 100 mm or less. When the cooling water used for cooling the steel strip 9 flows out from the space between the steel strip 9 and the protective members 10*a*, the cooling water prevents the laminar flow 13 of the cooling water jetted from the cooling water jetting nozzles 15 from colliding with the steel strip. In particular, when the distance Xa exceeds 100 mm, the flow velocity of the laminar flow 13 of the cooling water significantly decreases. This further disturbs the collision of the cooling water with the steel strip, failing in rapid cooling. As described above, the tips 16 of the cooling water jetting nozzles are disposed farther from the steel strip 9 than the surface, opposing the steel strip 9, of the protective members 10*a*. In other words, the distance Xa from the tips 16 of the cooling water jetting nozzles to the surface of the steel strip is determined to be longer than the distance Ya, which will be described below, from the top surfaces of the protective members 10*a* to the surface of the steel strip.

Figure 11A:
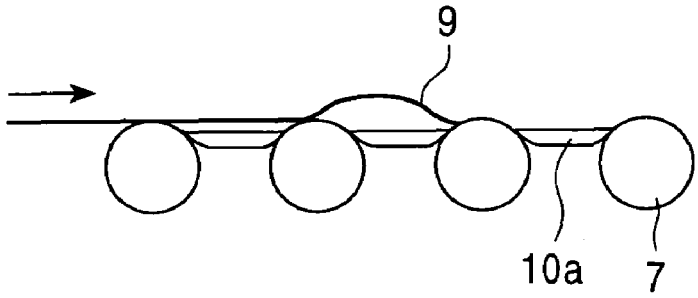
FIGS. 11A and 11B schematically show behavior of a leading end of steel strip during transfer.
Figure 11B:
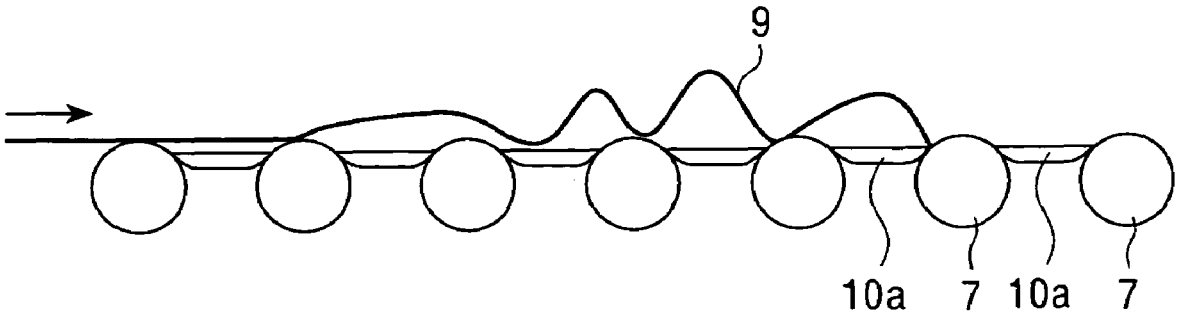

The distance Ya from the top surfaces of the protective members 10*a* to the surface of the steel strip is determined in view of stably transferring the steel strip 9 above the top surfaces of the protective members 10*a*. When the protective members 10*a* are disposed at the lower positions, as shown in FIG. 11A, the leading end of the transferred steel strip 9 bends downward to collide with the transfer rollers 7 and be bounced upward. The leading end of the steel strip 9 further undulates vertically as the steel strip 9 is transferred, disturbing stable transferring. In the worst case, as shown in FIG. 11B, the steel strip 9 may bend several times and cannot be transferred. Such a phenomenon will readily occur when the Ya exceeds 50 mm. On the other hand, when the Ya is smaller than 10 mm, the steel strip 9 comes into contact with the protective members 10*a*, causing scratching in the steel strip and also bending of the steel strip described above. Consequently, the Ya is preferably 10 to 50 mm.

Figure 3A:
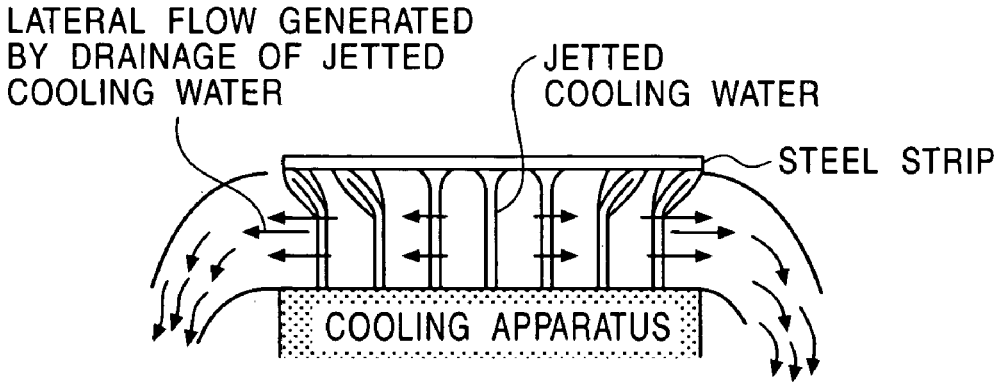
FIGS. 3A and 3B schematically show, respectively, behavior of cooling water and difference between target temperature and actual temperature in the width direction of steel strip when the space between cooling water jetting plate and steel strip in FIGS. 2A and 2B is widened.
Figure 3B:
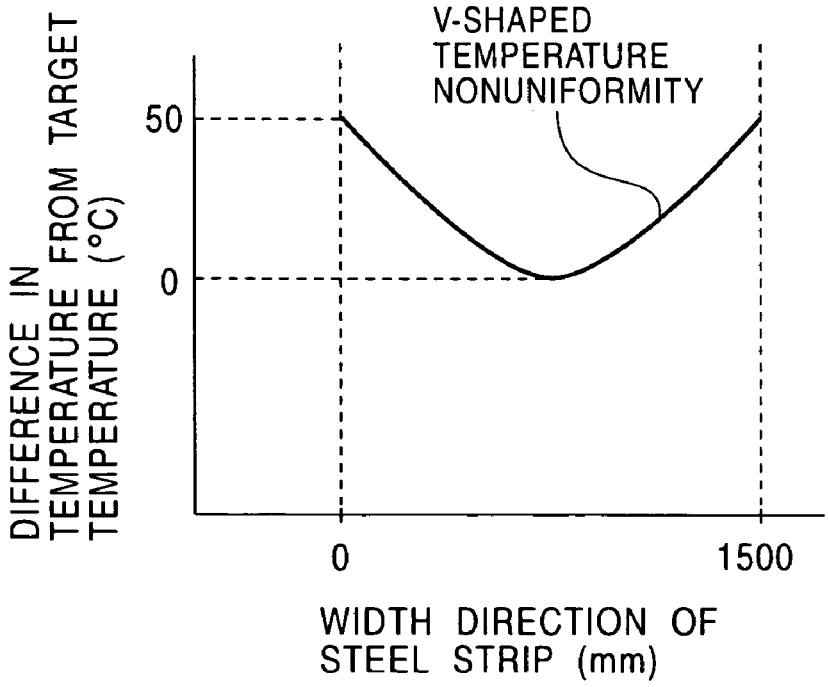

The distance Za from the bottom surfaces of the protective members 10*a* to the cooling water headers 12*a* yields a necessary space for rapidly draining the cooling water jetted from the cooling water jetting nozzles 15, and thus the Za is preferably larger. However, when the Za is too large, the cooling water jetting nozzles 15 protruding from the cooling water headers 12*a* must be significantly long. On the other hand, the ratio of the diameter of the cooling water jetting nozzle to the length of a straight run of the cylindrical laminar nozzle used in the cooling water jetting nozzles 15 is preferably 5 to 20. The ratio over 20 increases the flow resistance, and thus the supply pressure of the cooling water should be increased, which is not economical. When the ratio is less than 5, the cooling water is jetted in non-laminar flow as shown in FIG. 6B, resulting in insufficient cooling capability. The distance Za is determined in view of the cooling water amount drained through the cooling water passage holes 11 of the protective members 10*a*. More specifically, the cooling water jetted from the cooling water jetting nozzles 15 to cool the steel strip 9 flows into the space having the distance Ya between the protective members 10*a* and the steel strip and is drained through the following three paths: (i) both edges in the width direction of the space between the protective members 10*a* and the steel strip 9; (ii) the space between the protective members 10*a* and the transfer rollers 7; and (iii) the cooling water passage holes 11 provided in the protective members 10*a*. The space between the protective members 10*a* and the transfer rollers 7 is usually, for example, 1 mm or less so that the leading end of the steel strip 9 does not collide with the space. Consequently, the amount of cooling water drained through the path (ii) is small. On the other hand, if the amount of cooling water flowing through the path (i) is large, the flow from the center to both edges in the width direction becomes strong causing a V-shaped temperature profile, as shown in FIG. 3B, in the width direction. Therefore, to reduce the flow from the center to both edges in the width direction as much as possible, the protective members 10*a* should be provided with the cooling water passage holes 11 to drain the cooling water through the path (iii). Thereby, the area dimension of the cooling water passage holes 11 is determined, the amount of cooling water drained through the cooling water passage holes 11, which is the amount of cooling water falling on the cooling water headers 12*a*, is calculated from the planar dimension, and then the distance Za from the bottom surfaces of the protective members 10*a* to the cooling water headers 12*a* is determined. The cooling water that has fallen on the cooling water headers 12*a* is drained through the space between the cooling water headers 12*a* and the transfer rollers 7. When the cooling water remains due to insufficient draining, it disturbs the laminar flow 13 of the cooling water jetted from the cooling water jetting nozzles 15, resulting in heterogeneous cooling of the steel strip in the width direction. Therefore, sufficient space is important for draining the cooling water.

Figure 12:
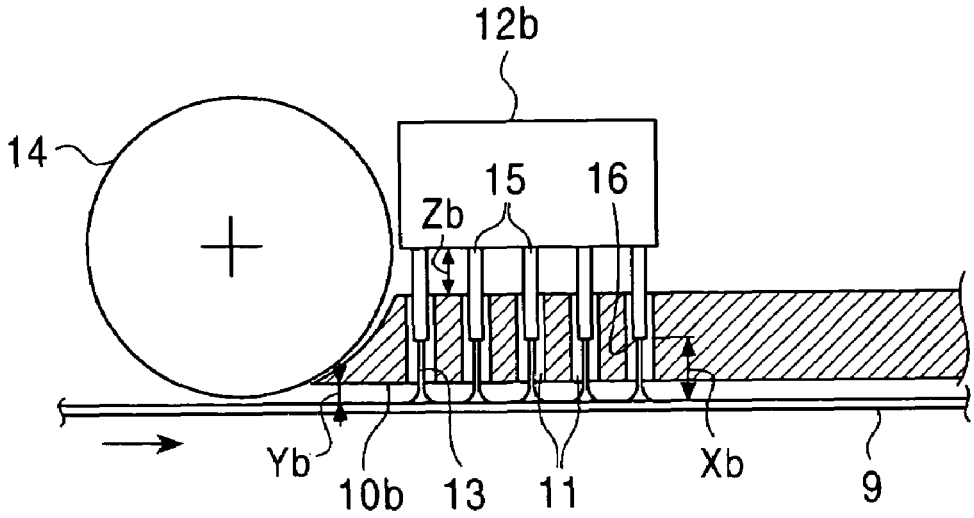
FIG. 12 shows an example of positional relationship between protective member, cooling water header and cooling water jetting nozzles in top surface cooling means.

FIG. 12 shows an example of positional relationship between protective member, cooling water header, and cooling water jetting nozzles in top surface cooling means.

The distance Xb from the tips 16 of the cooling water jetting nozzles to the surface of the steel strip 9, the distance Yb from the bottom surfaces of the protective members 10*b* to the surface of the steel strip, and the distance Zb from the top surfaces of the protective members 10*b* to the cooling water headers 12*b* are determined as follows.

The distance Xb from the tips 16 of the cooling water jetting nozzles to the surface of the steel strip in the top surface cooling means corresponds to the distance Xa in the bottom surface cooling means described above. In the top surface cooling means, since the cooling water remains on the steel strip 9, the distance is determined in additional view of the number and position of the guide rollers 14, the distance Yb between the bottom surfaces of the protective members 10*b* and the surface of the steel strip, and the thickness of the protective members 10*b*. Here, the distance Xb from the tips 16 of the cooling water jetting nozzles to the surface of the steel strip is preferably 100 mm or less, similar to the distance Xa in the bottom surface cooling means.

The distance Yb from the bottom surfaces of the protective members 10*b* to the surface of the steel strip corresponds to the distance Ya in the bottom surface cooling means described above and is preferably 10 to 50 mm, as in the bottom surface cooling means.

The distance Zb from the top surfaces of the protective members 10*b* to the cooling water headers 12*b* corresponds to the distance Za in the bottom surface cooling means and is determined in additional view of the number and position of the guide rollers 14 and the space between the guide rollers 14 and the steel strip 9. The area dimension of the cooling water passage holes 11 of the protective members 10*b* is also determined in view of the number and position of the guide rollers 14 and the space between the guide rollers 14 and the steel strip 9.

As shown in FIG. 12, the tips 16 of the cooling water jetting nozzles 15 in the top surface cooling means are preferably disposed inside the cooling water passage holes 11 of the protective members 10*b*. The reasons for this are as follows.

In the bottom surface cooling means, the cooling water jetted to the steel strip 9 flows down due to gravity through the cooling water passage holes 11 in the protective members 10*a*. On the other hand, in the top surface cooling means, the majority of the jetted cooling water is drained from both edges in the width direction. Therefore, the cooling water that is not drained from the space between the steel strip 9 and the protective members 10*b* flows into the space between the protective members 10*b* and the cooling water headers 12*b* from below the protective members 10*b* through the cooling water passage holes 11. Consequently, the tips 16 of the cooling water jetting nozzles 15 are preferably disposed inside the cooling water passage holes 11 so that the flow of the cooling water jetted from the cooling water jetting nozzles 15 is not affected by the drained water flowing toward both edges in the width direction in the space above the protective members 10*b* .

In the bottom surface cooling means, since the flow of the jetted cooling water may be affected by the drained water flowing toward both edges in the width direction in the space between the cooling water headers 12*a* and the protective members 10*a* depending on the amount of the drained water, the tips 16 of the cooling water jetting nozzles 15 are preferably disposed inside the cooling water passage holes 11 of the protective members 10*b* .

The guide rollers 14 provided above the transferred hot rolled steel strip 9 preferably has a gap about 5 mm from the surface of the hot rolled steel strip 9, when no problems, such as jamming of the leading end of the steel strip 9 or looping of the steel strip 9, occur during transfer. When the above-mentioned problems occur during transfer, the gap between the guide rollers 14 and the steel strip 9 is broadened so as not to raise the loop and to send the leading and trailing ends of the steel strip out of the cooling means. When the broadened gap between the guide rollers 14 and the steel strip 9 disturbs the drainage, a pinch roll is preferably provided at at least one position of the entry side, the delivery side, or between both sides of the cooling means to forcibly pinch the steel strip 9 and send it into or out the cooling means.

The above-mentioned cooling apparatus for hot rolled steel strip according to the present invention can almost uniformly jet the cooling water from above and below and rapidly cool the hot rolled steel strip while stable transfer of the steel strip is maintained by the protective members and the guide rollers. Since the cooling water jetted to the surface of the steel strip is properly drained and the influence of jetted cooling water flow is minimized to cool the hot rolled steel strip, rapid and uniform cooling in the width direction can be achieved.

As shown FIG. 4, when the cooling apparatus for hot rolled steel strip according to the present invention is provided on a run-out table in a production line for hot rolled steel strip, a steel strip can be stably and uniformly cooled at a cooling rate exceeding 200° C./s, and a hot rolled steel strip having excellent workability can be manufactured without fluctuation of properties nor degradation of shape.

EXAMPLE

Figure 13:
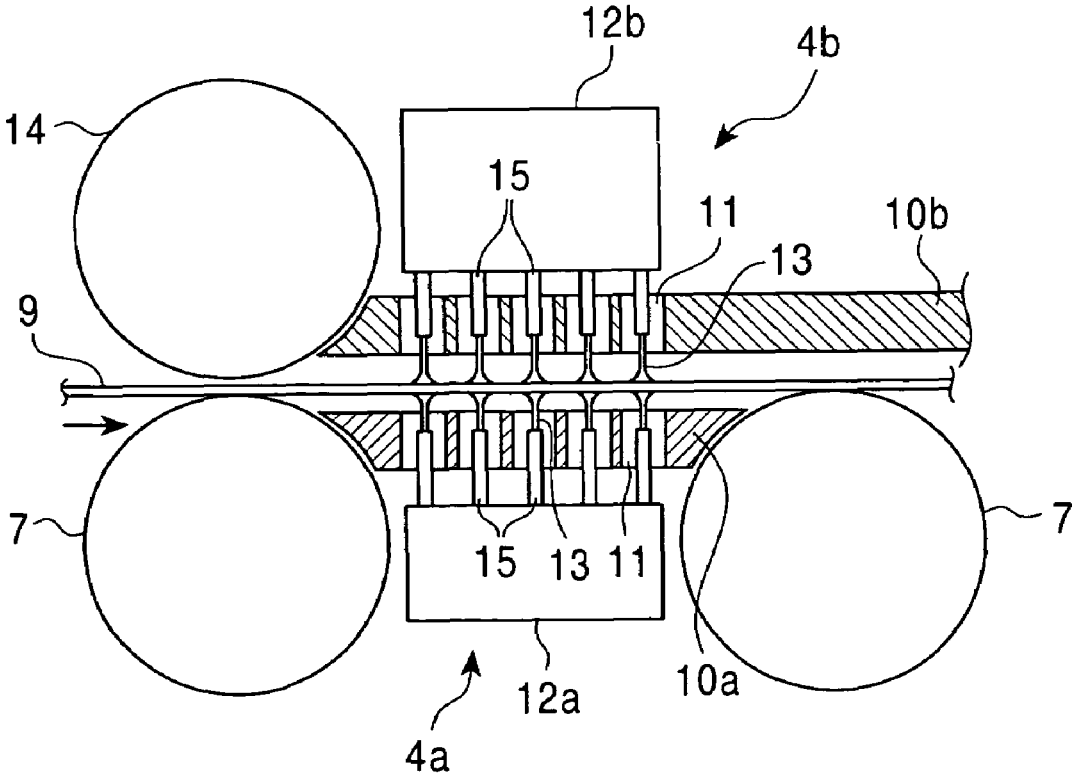
FIG. 13 shows another example of a cooling apparatus for hot rolled steel strip according to the present invention.
Figure 14:
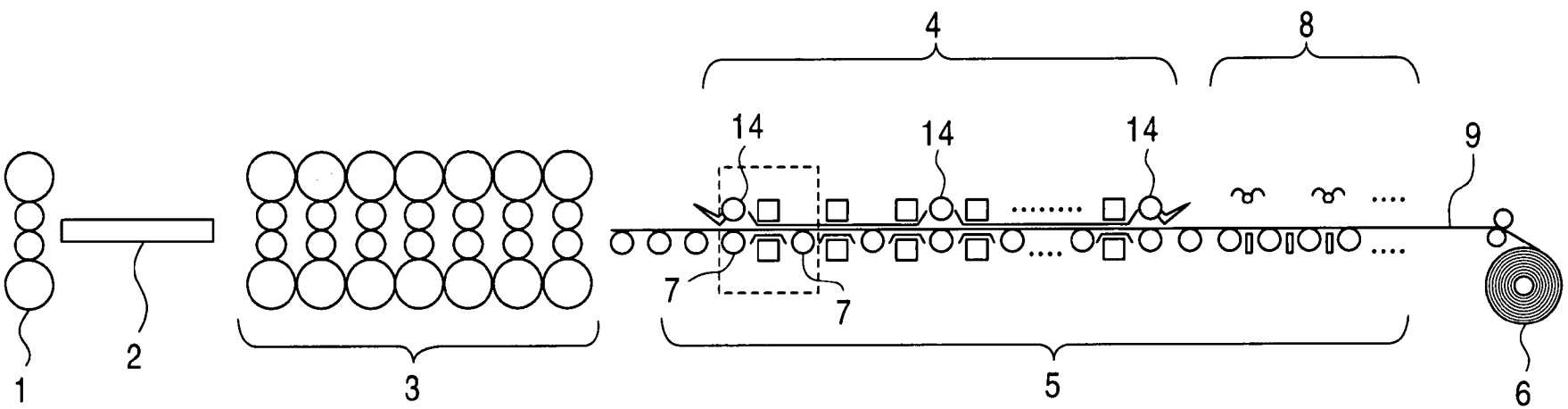
FIG. 14 shows a production line for hot rolled steel strip provided with the cooling apparatus shown in FIG. 13.

Using a production line for hot rolled steel strip shown in FIG. 14, which is provided with a cooling apparatus for hot rolled steel strip according to the present invention shown in FIG. 13, a sheet bar of carbon steel having a thickness of 30 mm and a width of 1,000 mm was rolled by a finishing mill having seven rolling stands at a transfer rate of 700 mpm and at a finishing temperature of 850° C. into a steel strip having a thickness of 3 mm. The steel strip was cooled to about 550° C. at a cooling rate of 700° C./s, and then cooled to a coiling temperature of 500° C. using a conventional cooling apparatus 8. The water flow rate was 7,500 L/min·m$^2$ for a cooling-rate of about 700° C./s.

As shown in FIG. 13, bottom surface cooling means 4*a* comprises a plurality of transfer rollers 7 having a diameter of 300 mm which are disposed in the longitudinal direction at a pitch of 500 mm, bottom surface protective member plates 10*a* having a thickness of 25 mm which are disposed between the transfer rollers 7 close and parallel to the surface of the transferred hot rolled steel strip 9, a plurality of cooling water passage holes 11 in the bottom surface protective member plates 10*a* as passages for cooling water, cooling water jetting nozzles 15 having outlets with a diameter of 5 mm, of which the tips are disposed at lower positions than the top surfaces of the protective member plates, and bottom surface cooling water headers 12*a* from which the cooling water jetting nozzles 15 protrude.

One bottom surface cooling water header 12*a* is disposed between two adjacent transfer rollers. The bottom surface cooling water headers 12*a* are provided with the cooling water jetting nozzles 15 used for jetting cooling water at the same pitch in both the width and the longitudinal directions. Laminar nozzles are used as the cooling water jetting nozzles 15.

The distance Xa between the surface of the steel strip and the tips 16 of the cooling water jetting nozzles is 25 mm, the distance Ya between the surface of the steel strip and the top surfaces of the bottom surface protective member plates 10*a* is 10 mm, and the distance Za between the bottom surface protective member plates 10*a* and the cooling water headers 12*a* is 30 mm.

Top surface cooling means 4*b* comprises three guide rollers 14 which are disposed to oppose the transfer rollers 7 and have a space of 5 mm from the steel strip 9, top surface protective member plates 10*b* having a thickness of 25 mm which are disposed close and parallel to the surface of the transferred hot rolled steel strip 9, a plurality of cooling water passage holes 11 in the top surface protective member plates 10*b* as passages for cooling water, cooling water jetting nozzles 15 having outlets with a diameter of 5 mm, of which the tips are disposed higher than the bottom surfaces of the protective member plates, and top surface cooling water headers 12*b* from which the cooling water jetting nozzles 15 protrude.

The top surface cooling water headers 12*b* are disposed to oppose the cooling water headers 12*a* of the bottom surface cooling means. The top surface cooling water headers 12*b* are provided with the cooling water jetting nozzles 15 used for jetting cooling water at a pitch of 30 mm in the width direction and at a pitch of 30 mm in the longitudinal direction. Laminar nozzles are used as the cooling water jetting nozzles 15.

The distance Xb between the surface of the steel strip and the tips 16 of the cooling water jetting nozzles is 30 mm, the distance Yb between the surface of the steel strip and the bottom surfaces of the top surface protective member plates 10*b* is 15 mm, and the distance Zb between the top surface protective member plates 10*b* and the top surface cooling water headers 12*b* is 30 mm.

Figure 15:
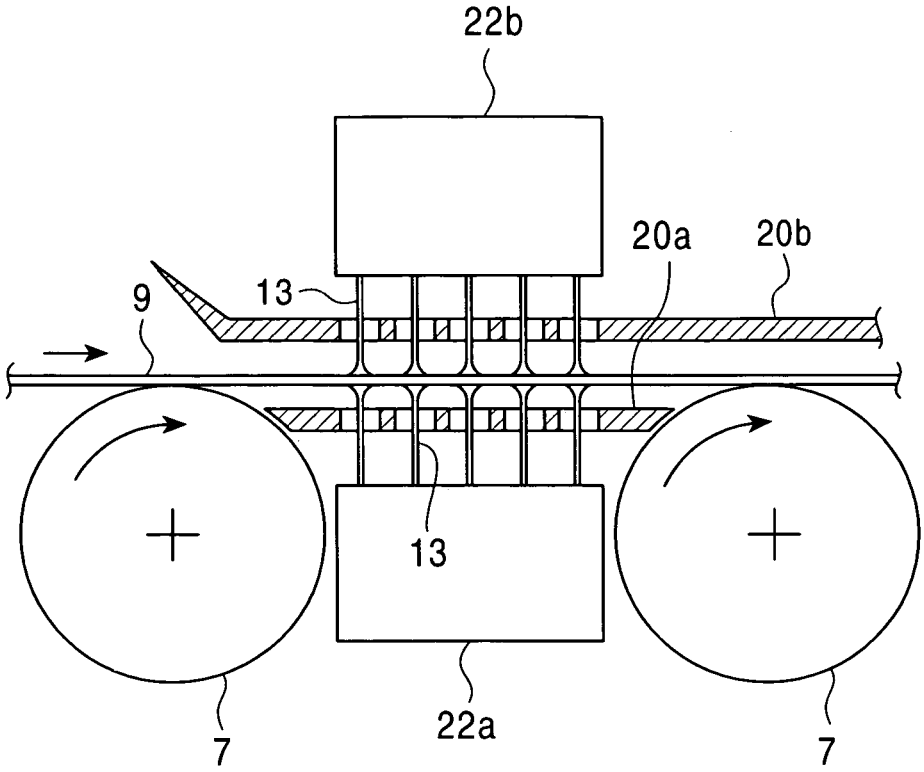
FIG. 15 shows a comparative example of a cooling apparatus for hot rolled steel strip.

As a comparative example, a similar test was carried out using a production line provided with a cooling apparatus for hot rolled steel strip shown in FIG. 15.

The cooling apparatus used in the comparative example has almost the same constitution as the cooling apparatus of the present invention shown in FIG. 13 except that the cooling water jetting nozzles are mounted in the cooling water headers 22 and that the nozzle tips are disposed on the surface of the cooling water headers 22. In this regard, the distance X between the surface of the steel strip and the tips of the cooling water jetting nozzles is 60 mm, the distance Y between the surface of the steel strip and the protective member plates 20 is 20 mm, and the distance Z between the protective member plates 20 and the cooling water headers 22 is 15 mm.

Figure 16:
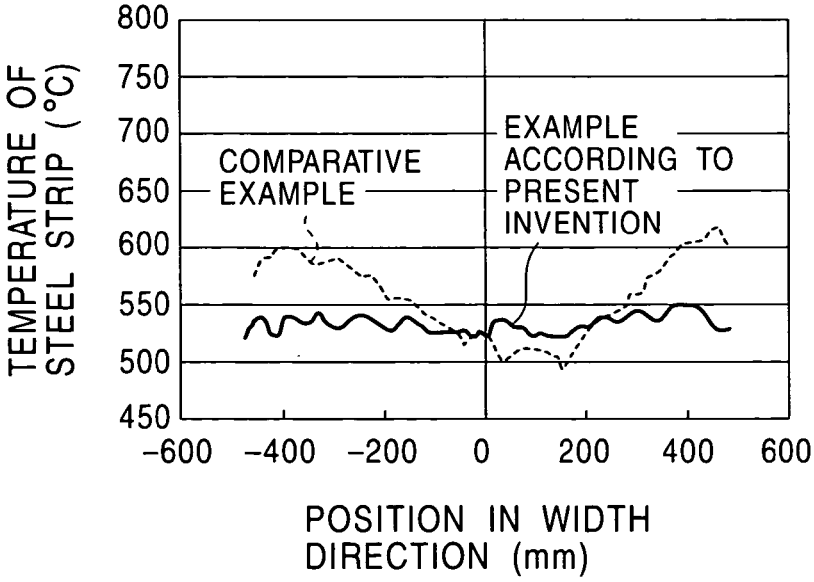
FIG. 16 shows temperature profile in the width direction of steel strip.

FIG. 16 shows temperature profile in the width direction of the steel strip.

When the cooling apparatus for hot rolled steel strip according to the present invention is used, the temperature profile in the width direction of the steel strip is around ±20° C., and almost uniform cooling in the width direction is achieved. In addition, the variation in strength of the hot rolled steel strip in the width direction is 20 MPa.

In contrast, in the comparative example, the temperature profile in the width direction of the steel strip is ±50° C. or more and shows the V-shaped profile in the width direction. Because of high temperature at both edges in the width direction of the steel strip, the steel strip is deformed and is not coiled normally. The variation in strength of the hot rolled steel strip in the width direction is 80 MPa.

When the protective member plates of the cooling apparatus used in the comparative example are disposed close to the steel strip, the temperature profile shows the inverted-V shape in the width direction of the steel strip.

The invention claimed is:

1. A cooling apparatus for a hot rolled steel strip comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member; and a plurality of cooling water jetting nozzles protruding from the at least one cooling water header for jetting cooling water approximately vertically toward the surface of the hot rolled steel strip through the at least one cooling water passage hole and for draining the cooling water through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member and the tips of the cooling water jetting nozzles are disposed inside the at least one cooling water passage hole of the protective member, wherein the at least one cooling water passage hole is slit shaped; and the longitudinal direction of the slit shaped at least one cooling water passage hole inclines in the horizontal plane with respect to the transferring direction of the hot rolled steel strip;

whereby cooling water is jetted from the plurality of the cooling water jetting nozzles through the slit shaped at least one cooling water passage hole.

2. A cooling apparatus for a hot rolled steel strip comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member; and a plurality of cooling water jetting nozzles protruding from the at least one cooling water header for jetting cooling water approximately vertically toward the surface of the hot rolled steel strip through the at least one cooling water passage hole and for draining the cooling water through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member and the tips of the cooling water jetting nozzles are disposed inside the at least one cooling water passage hole of the protective member, wherein the distance between the surface of the hot rolled steel strip and the surface, opposing the hot rolled steel strip, of the protective member is 10 to 50 mm, wherein the at least one cooling water passage hole is slit shaped; and the longitudinal direction of the slit shaped at least one cooling water passage hole inclines in the horizontal plane with respect to the transferring direction of the hot rolled steel strip; and whereby cooling water is jetted from a plurality of the cooling water jetting nozzles through the slit shaped at least one cooling water passage hole.

3. A method for cooling a hot rolled steel strip comprising introducing a hot rolled steel strip into a cooling apparatus for a hot rolled steel strip, the cooling apparatus comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member; and a plurality of cooling water jetting nozzles protruding from the at least one cooling water header for jetting cooling water approximately vertically toward the surface of the hot rolled steel strip through the at least one cooling water passage hole and for draining the cooling water through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member and the tips of the cooling water jetting nozzles are disposed inside the at least one cooling water passage hole of the protective member, wherein the cooling water header for the top surface cooling means is arranged to approximately oppose the cooling water header for the bottom surface cooling means separated by the hot rolled steel strip, and/or the cooling water jetting nozzles for the top surface cooling means are arranged to approximately oppose the cooling water jetting nozzles for the bottom surface cooling means separated by the hot rolled steel strip;

the distance between the surface of the hot rolled steel strip and the tips of the cooling water jetting nozzles is 100 mm or less;

the distance between the surface of the hot rolled steel strip and the surface, opposing the hot rolled steel strip, of the protective member is 10 to 50 mm;

the tips of the cooling water jetting nozzles are inside the at least one cooling water passage hole and the at least one cooling water passage hole is slit shaped;

the longitudinal direction of the slit shaped at least one cooling water passage hole inclines in the horizontal plane with respect to the transferring direction of the hot rolled steel strip, whereby cooling water is jetted from the plurality of the cooling water jetting nozzles through the slit shaped at least one cooling water passage hole; and a guide roller is provided above the hot rolled steel strip approximately opposing transfer rollers below the hot rolled steel strip at at least one position.

4. The method of cooling a hot rolled steel strip according to claim 3, wherein the hot rolled steel strip is cooled with a cylindrical laminar flow at a water flow rate exceeding 2,500 $L/min \cdot m^2$.

5. A production line comprising a run-out table provided with a cooling apparatus for a hot rolled steel strip, the cooling apparatus comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member;

a plurality of cooling water jetting nozzles protruding from the at least one cooling water header for jetting cooling water approximately vertically toward the surface of the hot rolled steel strip through the at least one cooling water passage hole and for draining the cooling water through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member and the tips of the cooling water jetting nozzles are disposed inside the at least one cooling water passage hole of the protective member, wherein the cooling water header for the top surface cooling means is arranged to approximately oppose the cooling water header for the bottom surface cooling means separated by the hot rolled steel strip, and/or the cooling water jetting nozzles for the top surface cooling means are arranged to approximately oppose the cooling water jetting nozzles for the bottom surface cooling means separated by the hot rolled steel strip;

the distance between the surface of the hot rolled steel strip and the tips of the cooling water jetting nozzles is 100 mm or less;

the distance between the surface of the hot rolled steel strip and the surface, opposing the hot rolled steel strip, of the protective member is 10 to 50 mm;

the tips of the cooling water jetting nozzles are inside the at least one cooling water passage hole and the at least one cooling water passage hole is slit shaped;

the longitudinal direction of the slit shaped at least one cooling water passage hole inclines in the horizontal plane with respect to the transferring direction of the hot rolled steel strip, whereby cooling water is jetted from the plurality of the cooling water jetting nozzles through the slit shaped at least one cooling water passage hole; and a guide roller is provided above the hot rolled steel strip approximately opposing transfer rollers below the hot rolled steel strip at least one position.

6. A cooling apparatus for a hot rolled steel strip comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member; and a plurality of cooling water jetting nozzles protruding from the at least one cooling water header for jetting cooling water approximately vertically toward the surface of the hot rolled steel strip through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member;

the at least one cooling water passage hole disposed in the protective member is slit shaped; and the longitudinal direction of the slit shaped at least one cooling water passage hole inclines in the horizontal plane with respect to the transferring direction of the hot rolled steel strip;

whereby cooling water is jetted from the plurality of cooling water jetting nozzles through the slit shaped at least one cooling water passage hole.

7. The cooling apparatus for a hot rolled steel strip of claim 6, wherein the cooling water header for the top surface cooling means approximately opposes the cooling water header for the bottom surface cooling means separated by the hot rolled steel strip, and/or the plurality of cooling water jetting nozzles of the top surface cooling means approximately oppose the cooling water jetting nozzles for the bottom surface cooling means separated by the hot rolled steel strip.

8. The cooling apparatus for a hot rolled steel strip of claim 6, wherein the distance between the surface of the hot rolled steel strip and the tips of the cooling water jetting nozzles is 100 mm or less.

9. he cooling apparatus for a hot rolled steel strip of claim 6, wherein the distance between the surface of the hot rolled steel strip and the surface, opposing the hot rolled steel strip, of the protective member is 10 to 50 mm.

10. The cooling apparatus for a hot rolled steel strip of claim 6, wherein a guide roller is provided above the hot rolled steel strip approximately opposing the transfer rollers below the hot rolled steel strip at least one position.

11. A cooling apparatus for a hot rolled steel strip comprising:

a top surface cooling means provided above a hot rolled steel strip which is transferred with transfer rollers after a hot rolling to cool the top surface of the hot rolled steel strip; and a bottom surface cooling means provided below the hot rolled steel strip to cool the bottom surface of the hot rolled steel strip, each of the top surface cooling means and the bottom surface cooling means comprising:

a protective member disposed close to the surface of the hot rolled steel strip, having at least one cooling water passage hole;

at least one cooling water header opposing the hot rolled steel strip separated by the protective member; and a plurality of cooling water jetting nozzles protruding from the at least one cooling water header for jetting cooling water approximately vertically toward the surface of the hot rolled steel strip through the at least one cooling water passage hole, said cooling water jetting nozzles having tips, wherein the tips of the cooling water jetting nozzles are disposed farther from the hot rolled steel strip than the surface, opposing the hot rolled steel strip, of the protective member, and the distance from the tips of the cooling water jetting nozzles to the surface of the steel strip is determined to secure an impinging velocity in view of the flow of the cooling water after cooling.

12. The cooling apparatus for a hot rolled steel strip of claim 11, wherein the cooling water header for the top surface cooling means approximately opposes the cooling water header for the bottom surface cooling means separated by the hot rolled steel strip, and/or the plurality of cooling water jetting nozzles of the top surface cooling means approximately oppose the cooling water jetting nozzles for the bottom surface cooling means separated by the hot rolled steel strip.

13. The cooling apparatus for a hot rolled steel strip of claim 11, wherein the distance between the surface of the hot rolled steel strip and the tips of the cooling water jetting nozzles is 100 mm or less.

14. The cooling apparatus for a hot rolled steel strip of claim 11, wherein the distance between the surface of the hot rolled steel strip and the surface opposing the hot rolled steel strip of the protective member is 10 to 50 mm.

15. The cooling apparatus for a hot rolled steel strip of claim 11, wherein a guide roller is provided above the hot rolled steel strip approximately opposing the transfer rollers below the hot rolled steel strip at least one position.

* * * * *